US008438035B2

(12) United States Patent
Endo et al.

(10) Patent No.: US 8,438,035 B2
(45) Date of Patent: May 7, 2013

(54) CONCEALMENT SIGNAL GENERATOR, CONCEALMENT SIGNAL GENERATION METHOD, AND COMPUTER PRODUCT

(75) Inventors: Kaori Endo, Kawasaki (JP); Yasuji Ota, Kawasaki (JP); Chikako Matsumoto, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 1256 days.

(21) Appl. No.: 11/967,403

(22) Filed: Dec. 31, 2007

(65) Prior Publication Data

US 2008/0208598 A1 Aug. 28, 2008

(30) Foreign Application Priority Data

Feb. 22, 2007 (JP) ..... 2007-042870

(51) Int. Cl.
*G10L 21/02* (2006.01)

(52) U.S. Cl.
USPC ..... 704/278; 704/E21.02

(58) Field of Classification Search ..... None
See application file for complete search history.

(56) References Cited

U.S. PATENT DOCUMENTS

| | | | | |
|---|---|---|---|---|
| 2005/0166124 | A1* | 7/2005 | Tsuchinaga et al. | 714/776 |
| 2006/0167693 | A1* | 7/2006 | Kapilow | 704/258 |
| 2009/0019343 | A1 | 1/2009 | Tashiro | |

FOREIGN PATENT DOCUMENTS

| | | | |
|---|---|---|---|
| JP | 02-001661 | | 1/1990 |
| JP | 2002542521 | | 12/2002 |
| JP | 2003316670 | | 11/2003 |
| JP | 2004138756 | | 5/2004 |
| JP | 2005338200 | | 12/2005 |
| JP | 2006053394 | | 2/2006 |
| WO | 0063885 | | 10/2000 |
| WO | 2006009074 | | 1/2006 |
| WO | WO 2006/079350 | A1 * | 8/2006 |

OTHER PUBLICATIONS

Office Action dated Jul. 7, 2009 for corresponding Japanese Patent Application No. JP 2007-042870.

European Search Report dated Sep. 20, 2011, from corresponding European Application No. 07 02 5207.

* cited by examiner

*Primary Examiner* — Angela A Armstrong
(74) *Attorney, Agent, or Firm* — Fujitsu Patent Center

(57) ABSTRACT

When there are missing voice-transmission-signals, a repetition-section calculating unit sets a plurality of repetition sections of different lengths that are determined to be similar to the voice-transmission-signals preceding the missing voice-transmission-signal, the repetition sections being determined with respect to stationary voice-transmission-signals stored in a normal signal storage unit, the stationary voice-transmission-signals being selected from the previously input voice-transmission-signals. A controller generates a concealment signal using the repetition sections.

10 Claims, 15 Drawing Sheets

CONCEALMENT SIGNAL GENERATOR, CONCEALMENT SIGNAL GENERATION METHOD, AND COMPUTER PRODUCT

BACKGROUND OF THE INVENTION

1. Field of the Invention

The present invention relates to a concealment signal generator, a concealment signal generation method, and a computer product that generate concealment signals for missing voice-transmission-signals, and more particularly, to a concealment signal generator, a concealment signal generation method, and a computer product that can generate signals with minimal sound quality deterioration.

2. Description of the Related Art

Conventionally, in a voice signal transmission by voice over Internet protocol (VoIP), when there are missing voice-transmission-signals due to a cause such as a transmission error, a method is used by which the missing voice-transmission-signals are concealed by generating substitute signals that replace the missing voice-transmission-signals, thus preventing interrupted voice (see Japanese Patent Application Laid-open No. 2004-138756, Japanese translation of PCT international application (kohyo) No. 2002-542521, and Japanese Patent Application Laid-open No. 2005-338200). Such substitute signals are called concealment signals.

A wave replication (WR) method and a pitch wave replication (PWR) method are known methods for generating the concealment signals. The WR method uses properly transmitted voice-transmission-signals, and generates the concealment signals by repeating a sound waveform at a position where a correlation with a waveform preceding the lost signal is large. PWR uses properly transmitted voice-transmission-signals, and generates the concealment signals by repeating a pitch waveform of one cycle preceding the loss.

However, when the concealment signals generated by the aforementioned conventional methods are used, an abnormal buzz-like noise is generated as a result of the repetition of the same waveform.

FIG. 15 is a schematic for explaining the problem related to the conventional concealment signal generation method and shows a concealment signal waveform when PWR method is used. As shown in FIG. 15, a last pitch waveform 3 of a section where the frame is transmitted properly (normal section) is repeated in a section where there are lost frames with no voice-transmission-signals (lost-frame section). Consequently, an unnatural buzz-like sound is heard due to the repetition of transmission of waveform of the same pitch and continuation of an unvarying sound.

SUMMARY OF THE INVENTION

It is an object of the present invention to at least partially solve the problems in the conventional technology.

According to an aspect of the present invention, a concealment signal generator that generates a concealment signal concealing a missing voice-transmission-signal includes a similar-section extracting unit that extracts from a previously input voice-transmission-signal a plurality of similar sections of different lengths determined to be similar to a voice-transmission-signal preceding the missing voice-transmission-signal, and a concealment signal generating unit that generates the concealment signal based on a voice-transmission-signal included in the similar sections extracted by the similar-section extracting unit.

According to another aspect of the present invention, a concealment signal generation method that generates a concealment signal concealing a missing voice-transmission-signal includes extracting from a previously input voice-transmission-signal a plurality of similar sections of different lengths determined to be similar to a voice-transmission-signal preceding the missing voice-transmission-signal, and generating the concealment signal based on a voice-transmission-signal included in the similar sections extracted by the extracting.

According to still another aspect of the present invention, a computer-readable recording medium stores therein a computer program that implements the above method on a computer.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the concealment signal generator, the concealment signal generation method, and the computer-readable recording medium according to the present invention are explained below in detail with reference to the accompanying drawings.

Figure 1A:
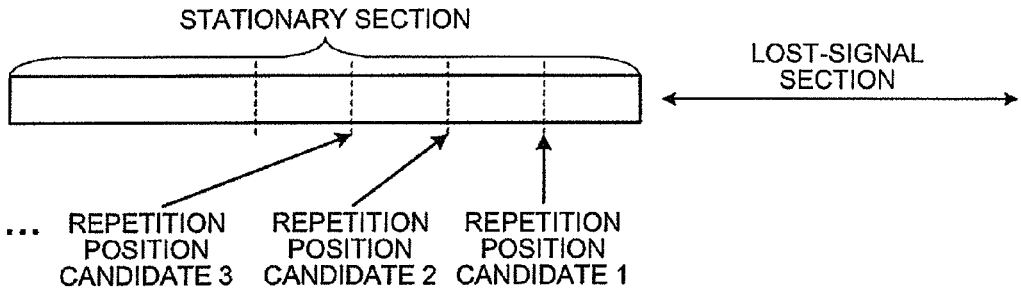
FIGS. 1A and 1B are schematics for explaining a concept of a concealment signal generation method according to a first embodiment of the present invention.
Figure 1B:
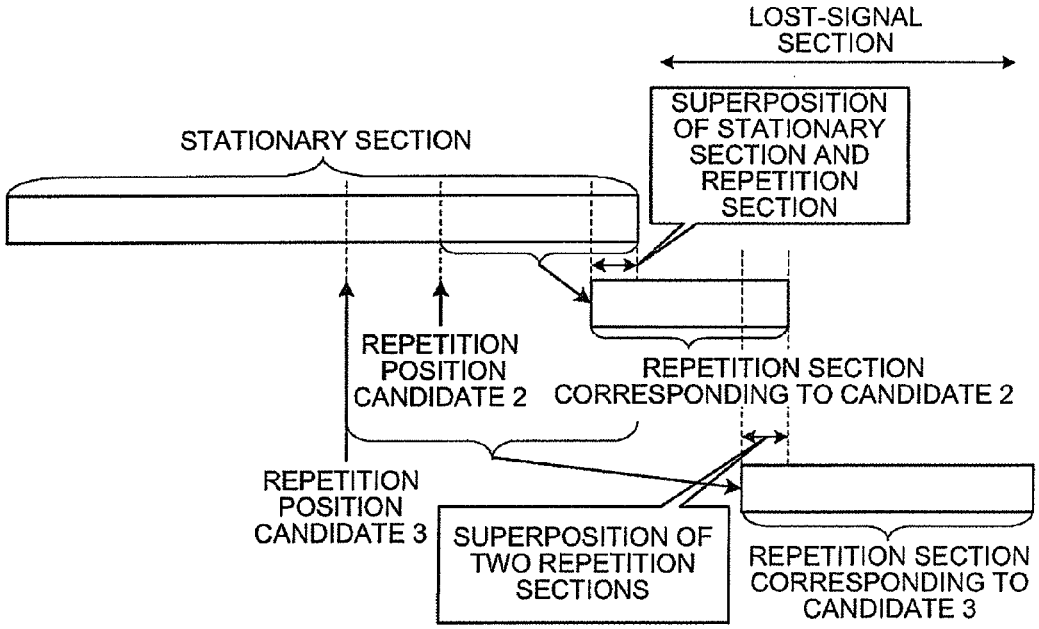

A concept of the concealment signal generation method according to a first embodiment of the present invention is explained first. FIGS. 1A and 1B are schematics for explaining the concept of the concealment signal generation method according to the first embodiment. In the concealment signal generation method according to the first embodiment, during a voice transmission such as voice over Internet protocol (VoIP), a concealment signal generator receives voice-transmission-signals, and continuously determines whether there is stationarity in the input voice-transmission-signals. In the period when the input voice-transmission-signals are stationary, the concealment signal generator stores the voice-transmission-signals input during that period as voice-transmission-signals of a stationary section (hereinafter, referred to as "stationary-section voice-transmission-signal").

Along with the determination of the stationarity, the concealment signal generator continuously determines whether there is a lost frame of the voice-transmission-signals. If it is determined that there is a lost frame, the concealment signal generator determines whether the voice-transmission-signals preceding the signals in the lost frame is stationary. When the signal is stationary, the concealment signal generator marks, as shown in FIG. 1A, a plurality of different positions within the stationary-section voice-transmission-signals theretofore stored. The marked positions are called repetition position candidates.

After marking the repetition position candidates, the concealment signal generator selects an arbitrary position as a repetition start position, and marks the section from the repetition start position to the end position of the stationary section as a repetition section. The concealment signal generator then retrieves the voice-transmission-signals from the repetition section. The signals retrieved from the repetition section are called repetitive signals.

The concealment signal generator retrieves a plurality of repetitive signals by repeating the process described above. Then, as shown in FIG. 1B, the concealment signal generator generates concealment signals for one frame by joining the repetitive signals. The concealment signal generator joins the voice-transmission-signals by overlapping the joints by a predetermined length, so that the sound included in the concealment signals is changed smoothly.

Thus, in the concealment signal generation method according to the first embodiment, when there are missing voice-transmission-signals, instead of outputting concealment signals in which signals having the same waveform are repeated a multiple number of times, the concealment signals are generated using the voice-transmission-signals retrieved from a plurality of repetition sections of different lengths that are determined to be similar to the voice-transmission-signals preceding the missing voice-transmission-signals marked on the previously input stationary-section voice-transmission-signal. Accordingly, the signal loss concealment method according to the first embodiment can prevent the occurrence of unnatural sound arising out of continuation of unvarying sound, and can generate concealment signals having minimal sound deterioration.

The term repetition section may be referred to as similar section.

Figure 2:
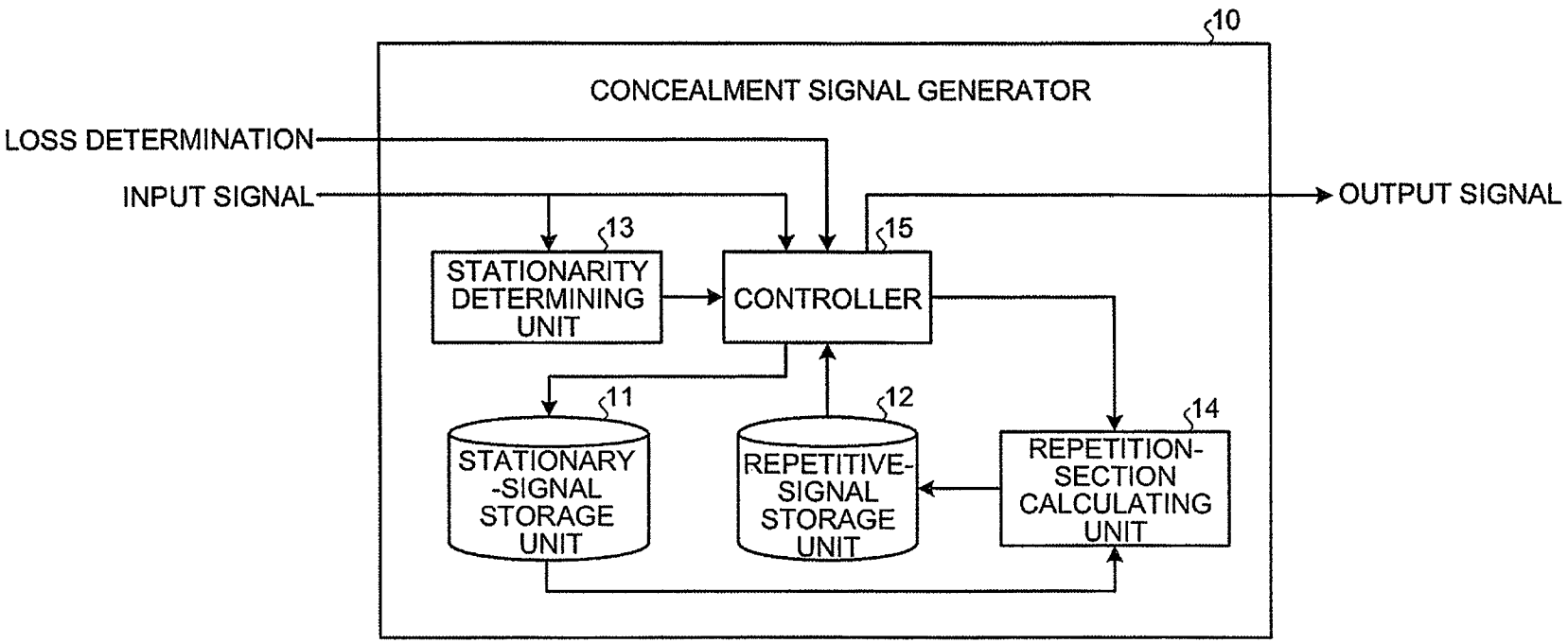
FIG. 2 is a functional block diagram of a concealment signal generator according to the first embodiment.

A configuration of the concealment signal generator according to the first embodiment is explained hereinafter. FIG. 2 is a functional block diagram of the concealment signal generator according to the first embodiment. As shown in FIG. 2, a concealment signal generator 10 includes a normal-signal storage unit 11, a repetitive-signal storage unit 12, a stationarity determining unit 13, a repetition-section calculating unit 14, and a controller 15.

The normal-signal storage unit 11 stores the voice-transmission-signals of the section, determined to be stationary by the stationarity determining unit 13 described later as stationary-section voice-transmission-signals. The repetitive-signal storage unit 12 stores the repetitive signals generated by the repetition-section calculating unit 14 described later.

The stationarity determining unit 13 determines whether there is stationarity in the voice-transmission-signals. Specifically, the stationarity determining unit 13 inputs the voice-transmission-signals frame-by-frame into a not shown signal input unit, and determines whether there is stationarity in the input voice-transmission-signals using a predetermined autocorrelation function, and notifies the outcome to the controller 15. A process performed by the stationarity determining unit 13 is explained in detail later.

The repetition-section calculating unit 14 retrieves the repetitive signals used for generating the concealment signals to be used when there are missing voice-transmission-signals. Specifically, the repetition-section calculating unit 14 sets a plurality of repetition position candidates from among the stationary-section voice-transmission-signals stored in the normal-signal storage unit 11 when an instruction to generate repetitive signals is received from the controller 15.

Figure 3:
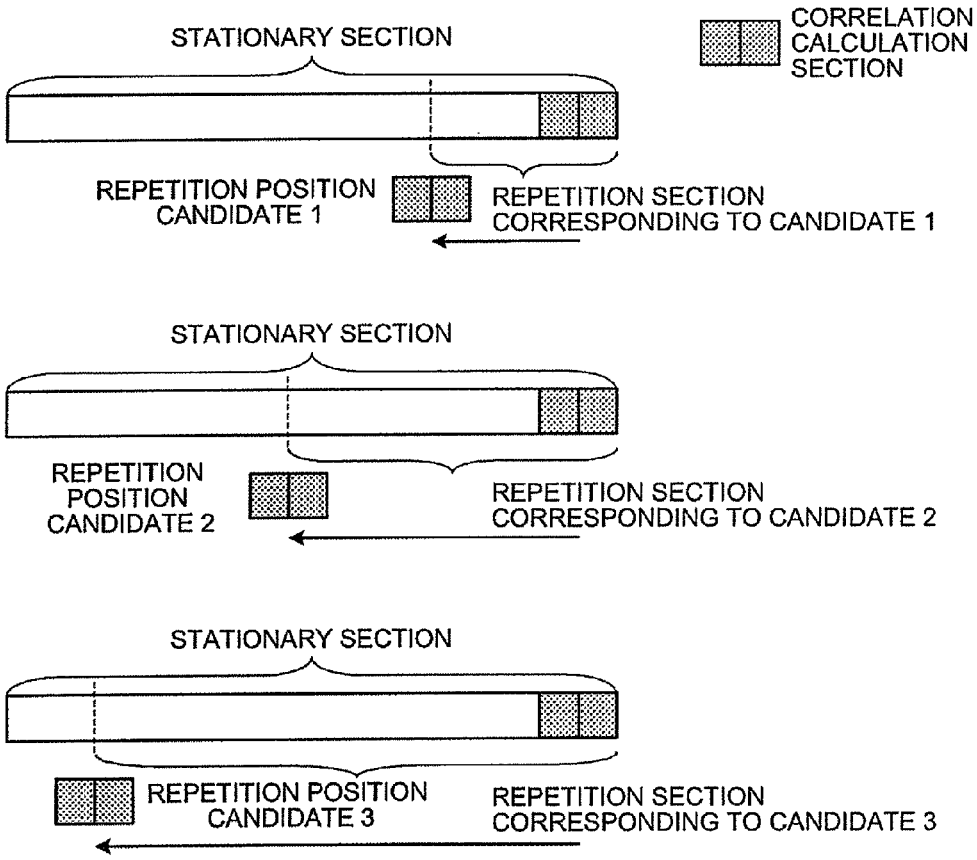
FIG. 3 is a schematic for explaining a setting of repetition sections by a repetition-section calculating unit.

FIG. 3 is a schematic for explaining a setting of repetition sections by the repetition-section calculating unit 14. As shown in FIG. 3, the repetition-section calculating unit 14 sets sections by tracking back by a predetermined period from the latest signal to an earlier signal as correlation calculation sections in the stationary section of the voice-transmission-signals stored in the normal-signal storage unit 11.

On setting the correlation calculation sections, the repetition-section calculating unit 14 calculates the degree of correlation of the stationary-section voice-transmission-signals with respect to the signals of the correlation calculation sections by a predetermined autocorrelation function progressing in the backward direction. The term degree of correlation may be referred to as degree of similarity.

While calculating the degree of correlation, the repetition-section calculating unit 14 sequentially detects the position of a signal for which the degree of correlation exceeds a predetermined threshold, and sets the detected position as a repetition position candidate. FIG. 3 shows that three repetition position candidates, namely, repetition position candidate 1, repetition position candidate 2, and repetition position candidate 3, are set.

After setting the repetition position candidates, the repetition-section calculating unit 14 generates a random numerical value using a widely known technique. The repetition-section calculating unit 14 generates the random numerical value within the number of candidates. The repetition-section calculating unit 14 then selects a repetition position candidate corresponding to the generated numerical value as a repetition start position, and sets the section ranging from the selected repetition start position to the end position of the stationary section as the repetition section.

Next, the repetition-section calculating unit 14 retrieves the voice-transmission-signals from the set repetition sections. The repetition-section calculating unit 14 confirms the length of the repetitive signals retrieved so far. If the length is less than the length of one frame, the repetition-section calculating unit 14 again generates the random numerical value, sets a new repetition section, retrieves the repetitive signals from the set repetition section, and joins the repetitive signals to the end of the repetitive signals already retrieved.

When joining the repetitive signals, the repetition-section calculating unit 14 joins a part of the signals to be joined by superposing the part of the signals on only half of the correlation calculation section, so that the sound in the junction changes smoothly. The superposing is performed using a widely known technique.

The repetition-section calculating unit 14 repeats the process until the repetitive signals of one frame length are retrieved. When the repetitive signals of one frame length are generated, the repetition-section calculating unit 14 stores the repetitive signals in the repetitive-signal storage unit 12, and notifies the controller 15 the completion of repetitive signal generation.

The controller 15 controls the input and output of the voice-transmission-signals and the repetitive signal generation. Specifically, the controller 15 first determines whether there are missing voice-transmission-signals based on information sent by a not shown input-signal interpreting unit that indicates whether there are missing voice-transmission-signals.

If it is determined that there are no missing voice-transmission-signals, the controller 15 determines whether there is stationarity in the voice-transmission-signals, based on the result of the determination of the stationarity determining unit 13 at that point of time. If it is determined that there is stationarity in the voice-transmission-signals, the controller 15 receives the voice-transmission-signals sent by the not shown signal input unit and stores the input voice-transmission-signals in the normal-signal storage unit 11.

If it is determined that there is no stationarity in the voice-transmission-signals, the controller 15 deletes all of the voice-transmission-signals stored in the normal-signal storage unit 11. Regardless of whether there is stationarity, the controller 15 outputs the input voice-transmission-signals to a not shown signal output unit.

If it is determined that there are missing voice-transmission-signals, the controller 15 determines whether there is stationarity in the voice-transmission-signals preceding the missing voice-transmission-signals, based on the result determined by the stationarity determining unit 13 at that point of time. If it is determined that there is no stationarity in the voice-transmission-signals, the controller 15 generates the concealment signals using the conventional methods (such as WR method, PWR method), and outputs the concealment signals to the signal output unit.

If it is determined that there is stationarity in the voice-transmission-signals, the controller 15 instructs the repetition-section calculating unit 14 to generate the repetitive signals. Upon notification from the repetition-section calculating unit 14 that the generation of repetitive signals is completed, the controller 15 retrieves the repetitive signals that are stored in the repetitive-signal storage unit 12, and outputs the retrieved repetitive signals as the concealment signals.

Figure 4:
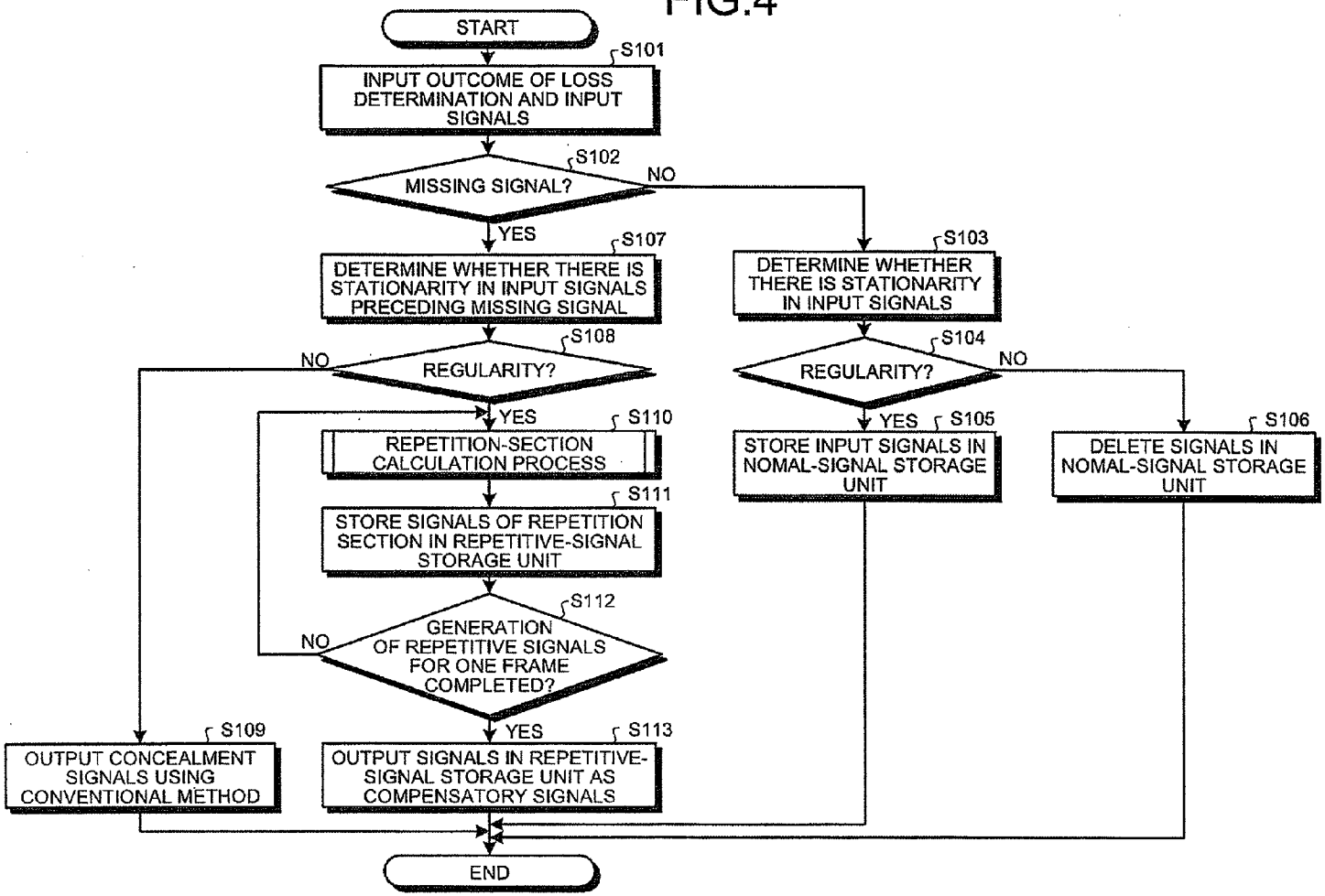
FIG. 4 is a flowchart of a process performed by the concealment signal generator according to the first embodiment.

A process performed by the concealment signal generator 10 according to the first embodiment is explained in the following. FIG. 4 is a flowchart of the process performed by the concealment signal generator 10 according to the first embodiment. As shown in FIG. 4, in the concealment signal generator 10, the controller 15 first receives a result of the loss determination from the input-signal interpreting unit and receives the voice-transmission-signal from the signal input unit, and determines whether there are missing input voice-transmission-signals (step S101).

If it is determined that there are no missing voice-transmission-signals (No at step S102), the controller 15 determines whether there is stationarity in the voice-transmission-signals (step S103). If there is stationarity (Yes at step S104), the controller 15 stores the voice-transmission-signals in the normal-signal storage unit 11 (step S105). Otherwise (No at step S104), the controller 15 deletes the voice-transmission-signals stored in the normal-signal storage unit 11 (step S106).

If it is determined that there are the missing voice-transmission-signals (Yes at step S102), the controller 15 determines whether there is stationarity in the voice-transmission-signals preceding the missing voice-transmission-signals (step S107). If there is no stationarity (No at step S108), the controller 15 generates the concealment signals using a conventional method, and outputs the concealment signals (step S109). If there is stationarity in the voice-transmission-signals preceding the missing voice-transmission-signals (Yes at step S108), the controller 15 instructs the repetition-section calculating unit 14 to generate the repetitive signals.

On receiving the instruction to generate the repetitive signals, the repetition-section calculating unit 14 performs a repetition-section calculation process (step S110) for setting the repetition sections, retrieves the repetitive signals from the repetition sections set as a result of the repetition-section calculation process, and stores the repetitive signals in the repetitive-signal storage unit 12 (step S111). The repetition-section calculation process is explained later.

The repetition-section calculating unit 14 performs the repetition-section calculation and signal retrieval until repetitive signals of one frame length are generated (No at step S112). Upon generating the repetitive signals of one frame length (Yes at step S112), the repetition-section calculating unit 14 notifies the controller 15 the completion of repetitive signal generation.

Upon receiving the notification of completion of repetitive signal generation, the controller 15 outputs the repetitive signals that are stored in the repetitive-signal storage unit 12 as the concealment signals (step S113).

Figure 5:
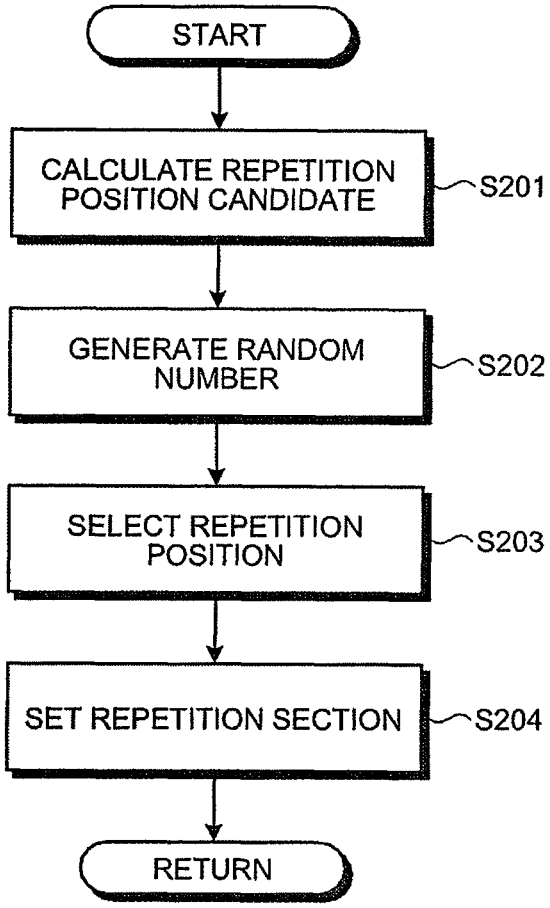
FIG. 5 is a flowchart of a repetition-section calculation process shown in FIG. 4.

The repetition-section calculation process shown in FIG. 4 is explained in the following. FIG. 5 is a flowchart of the repetition-section calculation process shown in FIG. 4. The repetition-section calculating unit 14 performs the repetition-section calculation process.

As shown in FIG. 5, the repetition-section calculating unit 14 first calculates the repetition position candidate (step S201), and generates the random number (step S202). Next, the repetition-section calculating unit 14 selects a repetition position from the repetition position candidates based on the random number (step S203), and sets the repetition section based on the repetition position (step S204).

Figure 6:
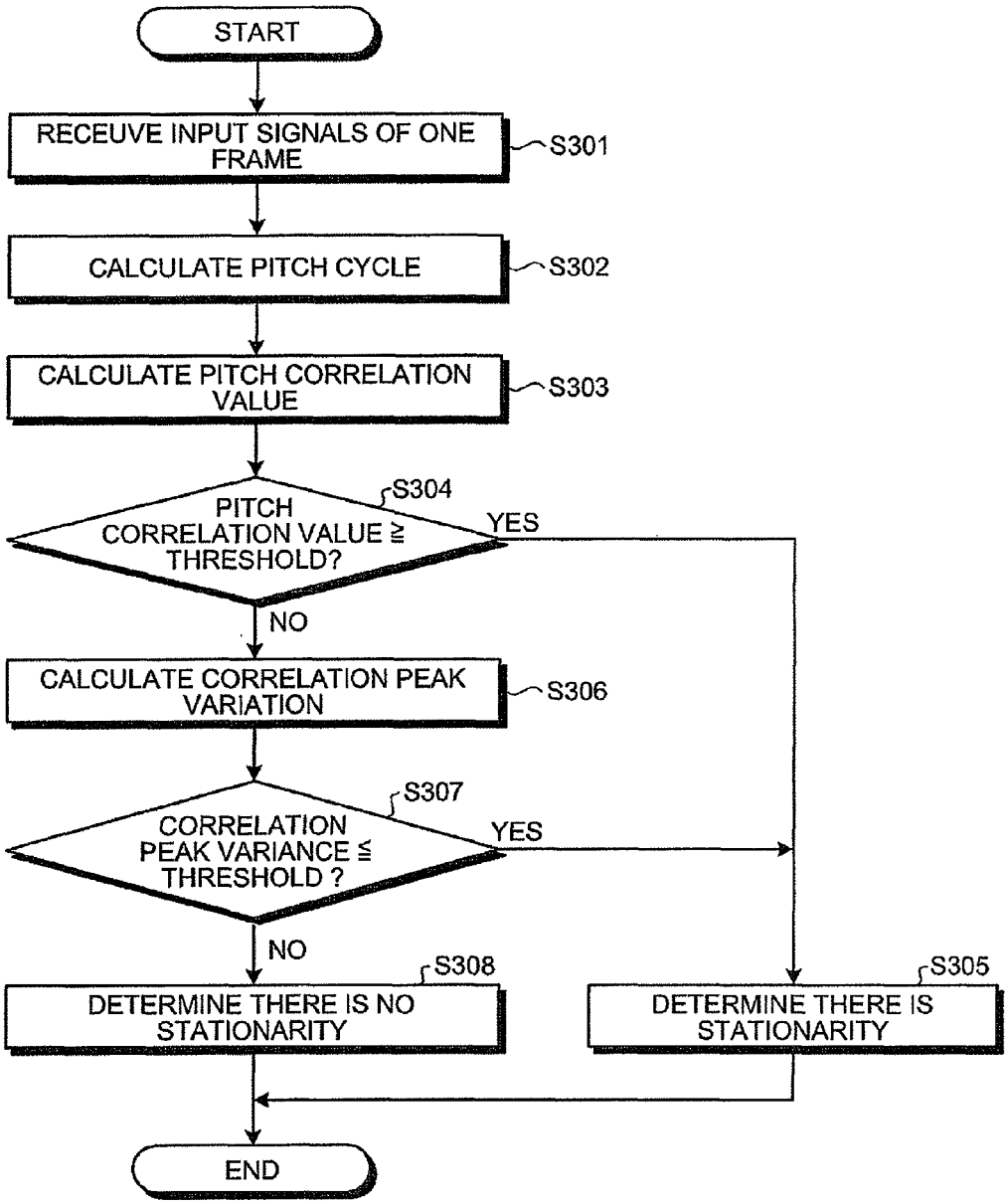
FIG. 6 is a flowchart of a process performed by a stationarity determining unit.

A process performed by the stationarity determining unit 13 according to the first embodiment is explained hereinafter. FIG. 6 is a flowchart of the stationarity determination process performed by the stationarity determining unit 13. As shown in FIG. 6, the stationarity determining unit 13 first receives the voice-transmission-signals of one frame (step S301), and calculates a pitch cycle of the input voice-transmission-signals (step S302).

The calculation of the pitch cycle is explained hereinafter in detail. When the voice-transmission-signals of one frame are received from the not shown signal input unit, the stationarity determining unit 13 sets a section between the frame end and a position that is a predetermined distance away toward frame head from the frame end as a correlation calculation section. Using a predetermined autocorrelation function, the stationarity determining unit 13 calculates sequentially the degree of correlation between the signals in the set correlation calculation section and signals within the frame, while shifting the position towards the frame head.

If i is a shift position from the frame tail, the autocorrelation function ac[i] for calculating the degree of correlation is given by Expression (1) given below.

$$ac[i] = \frac{\sum_{j=0}^{N-1} x(j)x(i+j)}{\sum_{j=0}^{N-1} x(j)^2} \quad (1)$$

In Expression (1), x(i) is a function representing an amplitude of the voice-transmission-signals at the shift position i, j is a shift position in the correlation calculation section, and N is a number of shift positions j in the correlation calculation section.

The stationarity determining unit 13 sequentially calculates the degree of correlation using the aforementioned autocorrelation function ac[i], while shifting the position towards the frame head. Next, the stationarity determining unit 13 identifies the position of the voice-transmission-signals within the frame at which the degree of correlation is the highest, and identifies the position as the pitch cycle.

After calculating the pitch cycle, the stationarity determining unit 13 calculates a pitch correlation value (step S303). The pitch correlation value is the degree of correlation of the pitch cycle. If p is the pitch cycle, the pitch correlation value ac_p is given by Expression (2) given below.

$$ac_p = ac[p] \quad (2)$$

If the calculated pitch correlation value ac_p calculated using Expression (2) is above a predetermined threshold (Yes at step S304), the stationarity determining unit 13 determines that there is stationarity in the voice-transmission-signals of the frame (step S305).

If the pitch correlation value ac_p is less than the threshold (No at step S304), the stationarity determining unit 13 calculates a correlation peak variance p_var using Expression (3) given below (step S306).

$$p_var = \max(ac[i])/\text{average}(\text{peak}_ac[k]),\ i=0, \ldots, L-1,\ k=0, \ldots, M-1 \quad (3)$$

In Expression (3), i is the shift position, L is the number of shift positions i, k is the position of the correlation peak detected at the time of calculating the degree of correlation using Expression (1), M is the number of correlation peaks, max(ac[i]) is the highest value of the degree of correlation ac[i], and average(peak_ac[k]) is the average value of a correlation peak peak_ac[k].

If the correlation peak variance p_var calculated using Expression (3) is less than or equal to a predetermined threshold (Yes at step S307), the stationarity determining unit 13 determines that there is stationarity in the voice-transmission-signals of the frame (step S307). If the correlation peak variance p_var is above the predetermined threshold (No at step S307), the stationarity determining unit 13 determines that there is no stationarity in the voice-transmission-signals of the frame (step S308).

Thus, by determining the stationarity of the input voice-transmission-signals, the stationarity determining unit 13 can generate the concealment signals based on the voice-transmission-signals similar to the voice-transmission-signals preceding the missing signal, thus enabling to generate concealment signals with minimal sound deterioration.

As a result of determining the stationarity based on the correlation peak variance, even in the case of inputting voice-transmission-signals with less periodicity, the stationarity determining unit 13 can set a section in the input voice-transmission-signals having minimal sound quality variation, as the stationary section. Accordingly, even if voice loss occurs in an environmental noise section, repetitive signals at different positions and with different lengths can be generated every time voice loss occurs, and concealment signals with minimal sound quality deterioration can be generated without an occurrence of periodicity due to the repetition.

As mentioned hereinbefore, in the first embodiment, when there are missing voice-transmission-signals, the repetition-section calculating unit 14 sets a plurality of repetition sections of different lengths and of which are determined to be similar to the voice-transmission-signals preceding the missing voice-transmission-signal. As also mentioned earlier, such plurality of repetition sections are determined to include stationary voice-transmission-signals among the previously input voice-transmission-signals stored in the normal-signal storage unit 11. Further, when there are missing voice-transmission-signals, the controller 15 generates the concealment signals using the voice-transmission-signals in the set repetition sections.

Further, in the first embodiment, the stationarity determining unit 13 determines the stationarity based on the correlation peak variance. However, the method to determine the stationarity is not limited to the correlation peak variance, and the stationarity can also be determined by a method in which amplitude variance of the voice-transmission-signals is used.

Figure 7:
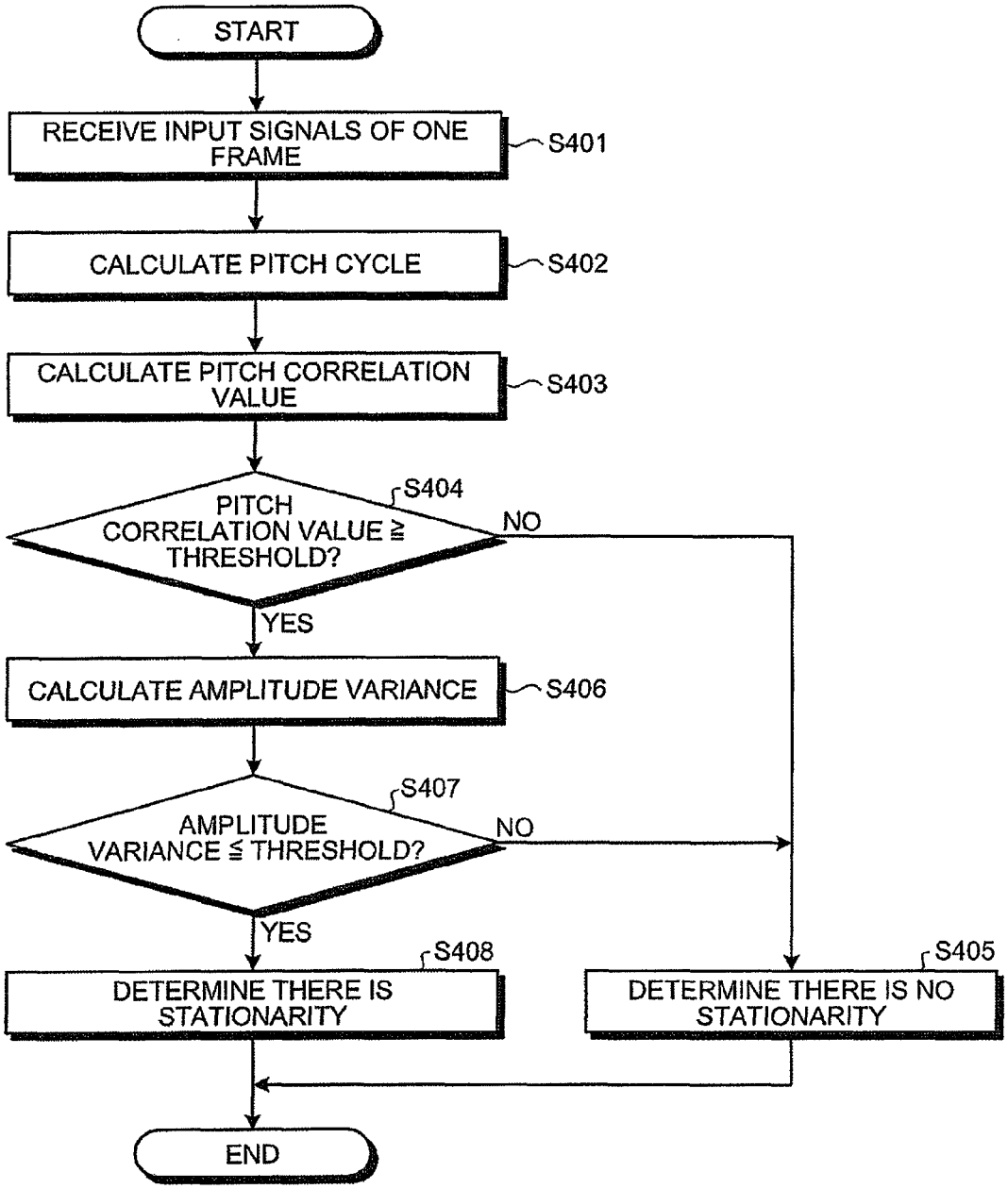
FIG. 7 is a flowchart of the process performed by the stationarity determining unit when an amplitude variance is used.

FIG. 7 is a flowchart of the process performed by the stationarity determining unit 13 when the amplitude variance is used. The process pertaining to the calculation of the pitch cycle and the pitch correlation value, shown in steps from S401 to S403 in FIG. 7, being same as the process shown in steps from S301 to S304 in FIG. 6, is not explained.

If the calculated pitch correlation value ac_p is less than a predetermined threshold (No at step S404), the stationarity determining unit 13 determines that there is no stationarity in the voice-transmission-signals of the frame (step S405).

If the pitch correlation value ac_p is greater than or equal to the predetermined threshold (Yes at step S404), the stationarity determining unit 13 calculates an amplitude variance a_var (step 406) using Expression (4) given below.

$$a_var = \max(\text{amp_pitch}[i])/\text{average}(\text{amp_pitch}[i]),\ i=0, \ldots, F-1 \quad (4)$$

In Expression (4), F is the number of pitch cycles, and amp_pitch[i] is amplitude of ith pitch cycle. Here, an absolute value of a maximum signal included in the pitch cycle corresponds to the amplitude of the pitch cycle. max(amp_pitch[i]) is the highest value of the pitch cycle amplitude amp_pitch[i]. average(amp_pitch[i]) is the average value of the pitch cycle amplitude amp_pitch[i].

If the amplitude variance a_var calculated by Expression (4) is less than or equal to a predetermined threshold (Yes at step S407), the stationarity determining unit 13 concludes that there is stationarity in the voice-transmission-signals of the frame (step S408). If the calculated amplitude variance a_var is greater than the predetermined threshold (No at step S407), the stationarity determining unit 13 concludes that there is no stationarity in the voice-transmission-signals of the frame (step S405).

Thus, as a result of determining the stationarity based on the amplitude variance, the stationarity determining unit 13 is able to eliminate signals of a section for which there is a possibility of sound quality deterioration when used as repetitive signals because the amplitude variance is large. As a result, concealment signals with minimal sound quality deterioration can be generated.

So far, the stationarity determination based on either the correlation peak variance or the amplitude variance is explained. It is also acceptable to use both, the correlation peak variance and the amplitude variance to determine the stationarity.

Figure 8:
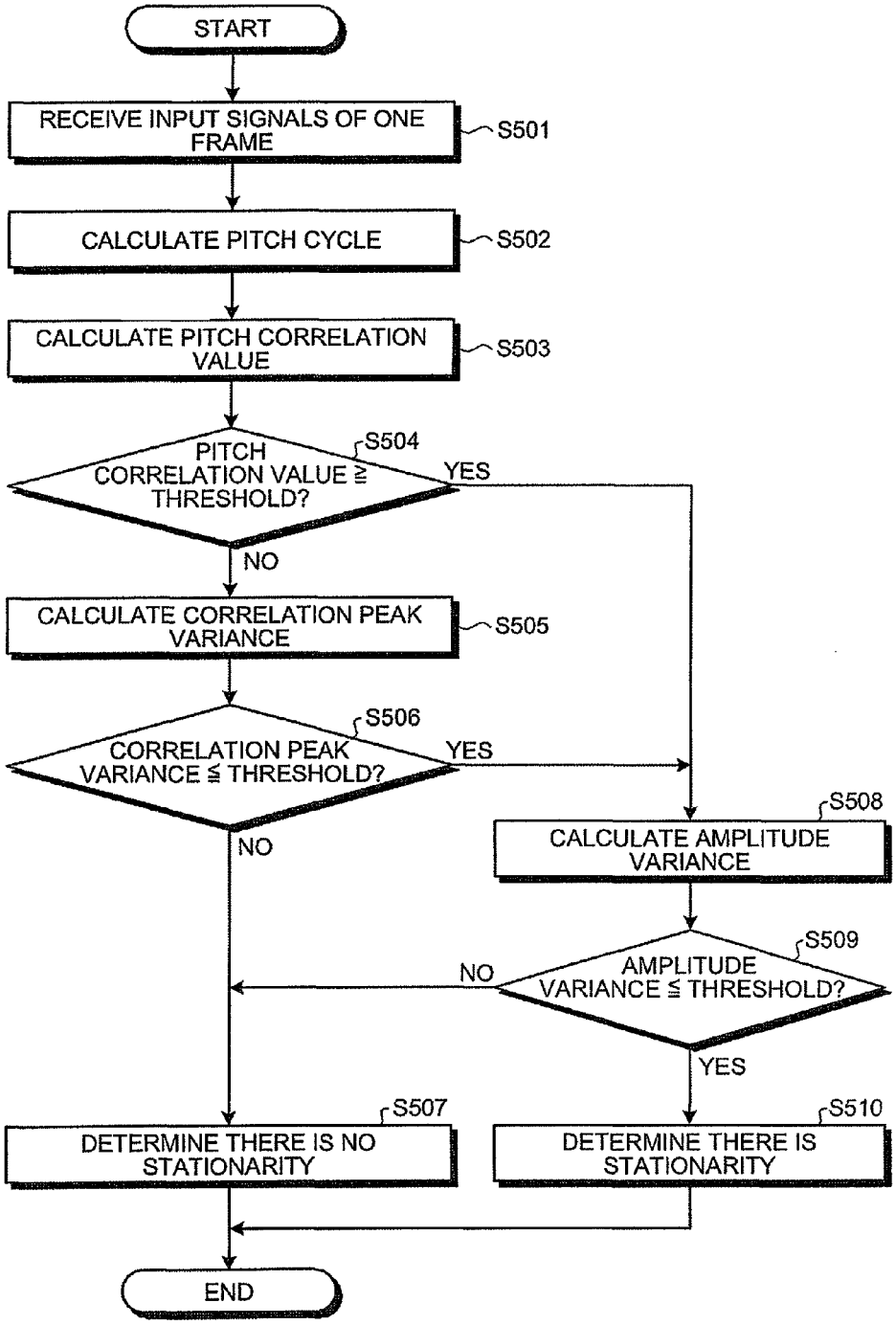
FIG. 8 is a flowchart of the process performed by the stationarity determining unit when a correlation peak variance and an amplitude variance are used.

FIG. 8 is a flowchart of a process performed by the stationarity determining unit 13 when the correlation peak variance and the amplitude variance are used. The process pertaining to the calculation of the pitch cycle and the pitch correlation value, shown in steps from S501 to S503 in FIG. 8, being same as the process shown in steps from S301 to S304 in FIG. 6, is not explained.

If the calculated pitch correlation value ac_p is less than the predetermined threshold (No at step S504), the stationarity determining unit 13 calculates the peak correlation value p_var using Expression (3) mentioned hereinbefore (step 505).

If the calculated correlation peak variance p_var is greater than the predetermined threshold (No at step S506), the stationarity determining unit 13 determines that there is no stationarity in the voice-transmission-signals of the frame (step S507).

If the pitch correlation value ac_p is greater than or equal to the predetermined threshold (Yes at step S504), or the correlation peak variance p_var is less than or equal to the predetermined threshold (Yes at step S506), the stationarity determining unit 13 calculates the amplitude variance using aforementioned Expression (4) (step S508).

If the calculated amplitude variance a_var is less than or equal to the predetermined threshold (Yes at step S509), the stationarity determining unit 13 determines that there is stationarity in the voice-transmission-signals of the frame (step S510). If the calculated amplitude variance a_var is greater than the predetermined threshold (No at step S509), the stationarity determining unit 13 determines that there is no stationarity in the voice-transmission-signals of the frame (step S507).

As a result of determining the stationarity based on the correlation peak variance and the amplitude variance, even in the case of inputting voice-transmission-signals with less periodicity, the stationarity determining unit 13 can set a section in the input voice-transmission-signals, which has less sound quality variation, as the stationary section. In addition, the stationarity determining unit 13 can eliminate signals of a section for which there is a possibility of sound quality deterioration when used as repetitive signals because the amplitude variance is large. As a result, concealment signals with further minimized sound quality deterioration can be generated.

In the first embodiment, it is explained that the concealment signals are generated using repetitive signals retrieved from a plurality of repetition sections that differ in length and/or position. When repetitive signals retrieved from a long repetition section are used, there is a possibility that the repetitive signals include a plurality of completely identical signals. In such a case, there is a possibility of occurrence of periodicity in the concealment signals due to the identical signals.

A case is explained below, as a second embodiment according to the present invention, in which a variation signal having amplitude varying randomly over time is mixed with the repetitive signals retrieved from the repetition section, so that a plurality of completely identical signals is not included in the concealment signals.

Figure 9:
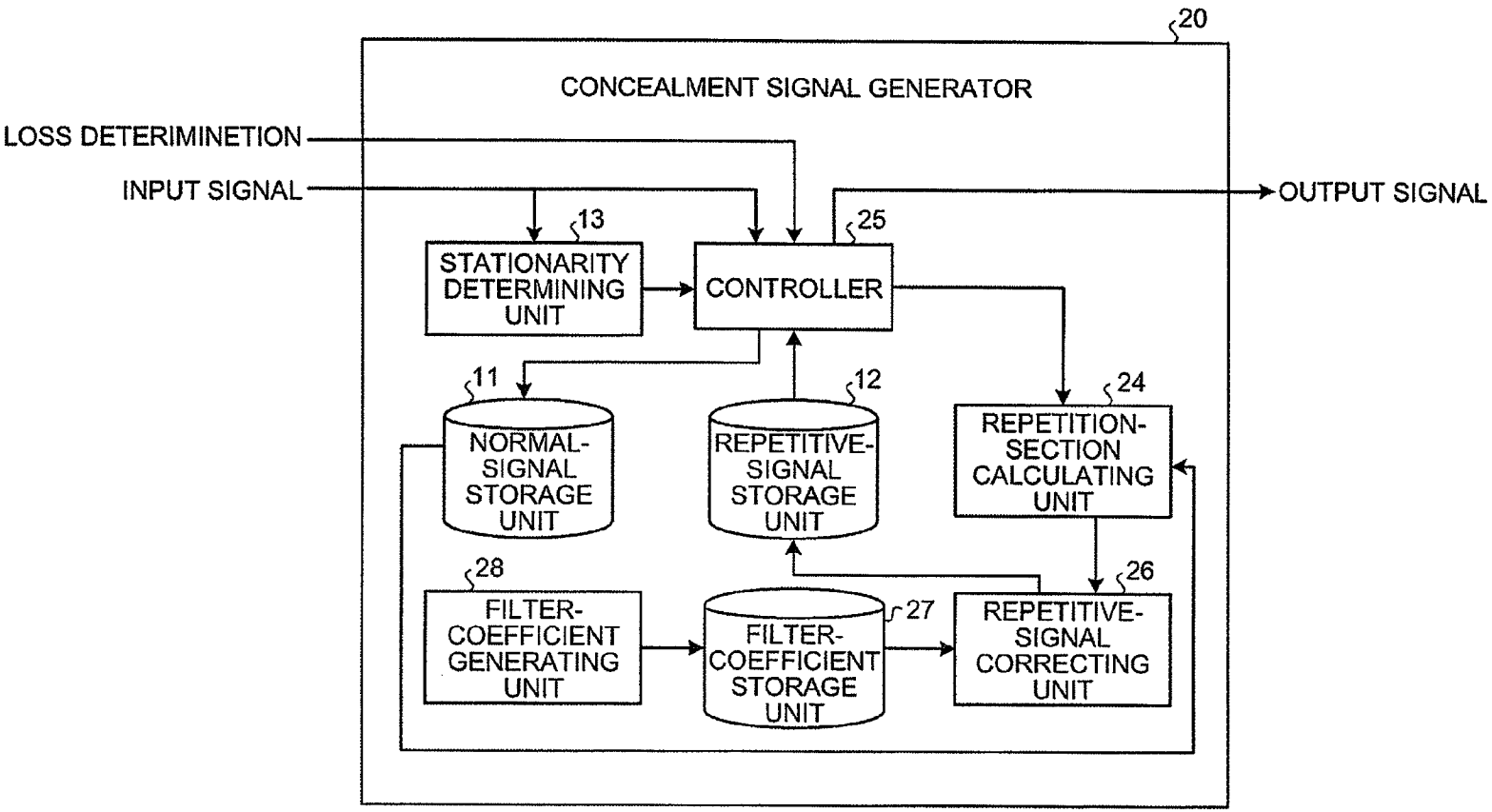
FIG. 9 is a functional block diagram of a concealment signal generator according to a second embodiment of the present invention.

A structure of the concealment signal generator according to the second embodiment is explained first. FIG. 9 is a functional block diagram of the concealment signal generator according to the second embodiment. The functional units that have the same functions as those of the corresponding units shown in FIG. 2 are assigned the same reference numerals, and detailed explanations thereof are omitted.

As shown in FIG. 9, a concealment signal generator 20 includes the normal-signal storage unit 11, the repetitive-signal storage unit 12, the stationarity determining unit 13, a repetition-section calculating unit 24, a controller 25, a filter-coefficient storage unit 27, a filter-coefficient generating unit 28, and a repetitive-signal correcting unit 26.

The repetition-section calculating unit 24 generates the repetitive signals used to generate concealment signals when there are missing voice-transmission-signals. Specifically, the repetition-section calculating unit 24 generates the repetitive signals in the same manner as the repetition-section calculating unit 14 explained in the first embodiment, when an instruction to generate the repetitive signal is received from the controller 25. The repetition-section calculating unit 24 sends the generated repetitive signals to the repetitive-signal correcting unit 26.

The controller 25 controls the input and output of the voice-transmission-signals, and controls the generation of the repetitive signal. Specifically, based on whether there is stationarity in the voice-transmission-signals, the controller 25, in the same manner as the controller 15 explained in the first embodiment, stores the voice-transmission-signals in the normal-signal storage unit 11, deletes the voice-transmission-signals stored in the normal-signal storage unit 11, and outputs the concealment signal based on whether there are missing voice-transmission-signals.

In the first embodiment, when it is notified by the repetition-section calculating unit 14 that the generation of the repetitive signals is completed, the controller 15 retrieves the repetitive signals that are stored in the repetitive-signal storage unit 12, and outputs the retrieved repetitive signals as the concealment signals. In the second embodiment, when it is notified by the repetitive-signal correcting unit 26 that the correction of the repetitive signals is completed, the controller 25 retrieves the repetitive signals that are stored in the repetitive-signal storage unit 12, and outputs the retrieved repetitive signals as the concealment signals.

The repetitive-signal correcting unit 26 corrects the repetitive signals generated by the repetition-section calculating unit 24, using a filter coefficient stored in the filter-coefficient storage unit 27. Specifically, when the repetition-section calculating unit 24 sends the repetitive signals, the repetitive-signal correcting unit 26 retrieves the filter coefficient stored in the filter-coefficient storage unit 27, and applies the retrieved filter coefficient to correct the repetitive signals sent by the repetition-section calculating unit 24.

After the repetitive signals are corrected, the repetitive-signal correcting unit 26 stores the corrected repetitive signals in the repetitive-signal storage unit 12, and notifies the controller 25 the completion of the correction of the repetitive signals. A repetitive-signal correction process performed by the repetitive-signal correcting unit 26 is explained later.

The filter-coefficient storage unit 27 stores the filter coefficient generated by the filter-coefficient generating unit 28 described later.

The filter-coefficient generating unit 28 generates the filter coefficient required for correcting the repetitive signals generated by the repetition-section calculating unit 24. Specifically, the filter-coefficient generating unit 28 calculates a frequency characteristic correction coefficient for each predetermined frequency band unit, based on a preset variation band. The filter-coefficient generating unit 28 transforms the calculated frequency characteristic correction coefficient into a time-domain coefficient using a widely known transformation technique such as inverse fast Fourier transforms (FFT), and stores the converted time-domain coefficient as the filter coefficient in the filter-coefficient storage unit 27. The frequency characteristic correction coefficient is a multiplying factor operated on a power spectrum of each frequency band. The process of filter coefficient generation by the filter-coefficient generating unit 28 is explained in detail later.

Figure 10:
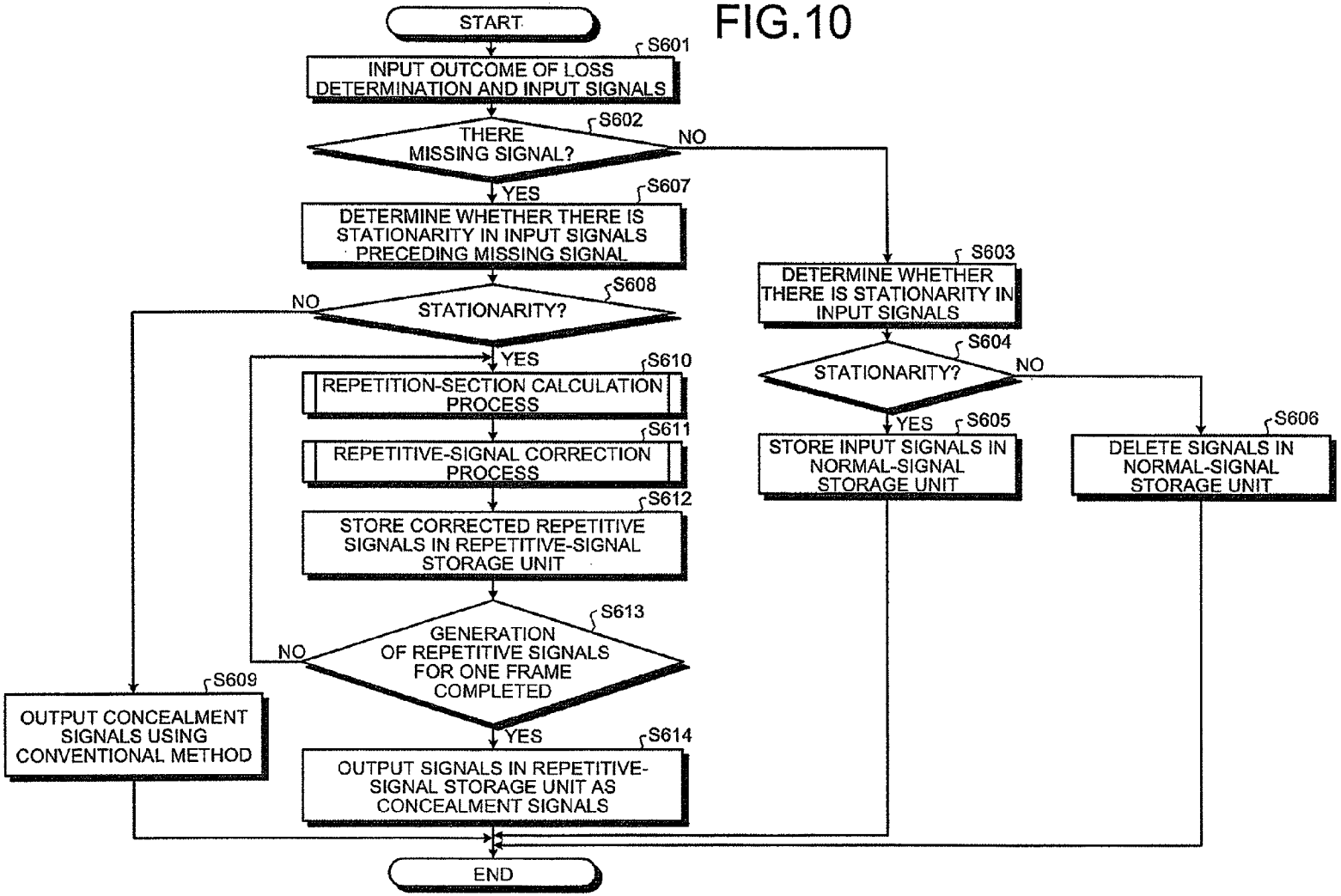
FIG. 10 is a flowchart of a process performed by the concealment signal generator according to the second embodiment.

A process performed by the concealment signal generator according to the second embodiment is explained in the following. FIG. 10 is a flowchart of a process performed by the concealment signal generator according to the second embodiment. Explanations of the process shown in steps from S601 to S609 in FIG. 10, being same as the process shown in steps from S101 to S109 in FIG. 4, are omitted.

On receiving an instruction from the controller 25 to generate the repetitive signals, the repetition-section calculating unit 24 performs the repetition-section calculation process (step S610) for setting the repetition sections, retrieves the repetitive signals from the repetition sections set as a result of the repetition-section calculation process, and sends the signals to the repetitive-signal correcting unit 26. The repetition-section calculation process of step S610, being same as the repetition-section calculation process shown in FIG. 5, is not described.

Upon receiving the repetitive signals, the repetitive-signal correcting unit 26 performs the repetitive-signal correction process (step S611) for correcting the repetitive signal. The repetition signal correction process is explained later.

The repetitive-signal correcting unit 26 stores the corrected repetitive signals in the repetitive-signal storage unit 12 (step S612). The repetition signal correction process is explained later.

The repetition-section calculating unit 24 performs the retrieval and correction of the repetitive signals until repetitive signals of one frame length are generated (No at step S613). Upon generating and correcting the repetitive signals of one frame length (Yes at step S613), the repetition-section calculating unit 24 notifies the controller 25 the completion of repetitive signal correction.

Upon receiving the notification of completion of repetitive signal correction, the controller 25 outputs the signals stored in the repetitive-signal storage unit 12 as the concealment signals (step S614).

Figure 11:
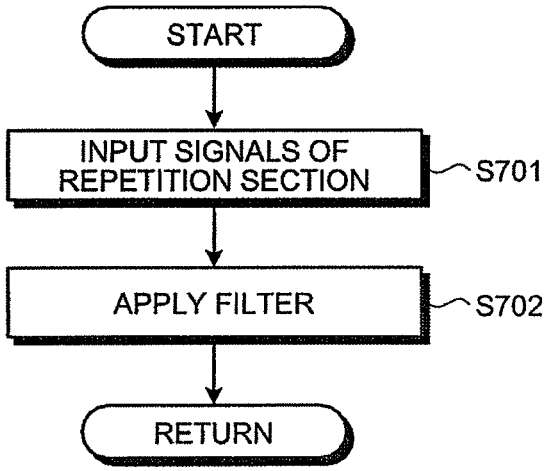
FIG. 11 is a flowchart of a repetitive-signal correction process shown in FIG. 10.

The repetitive-signal correction process shown in FIG. 10 is explained in the following. FIG. 11 is a flowchart of the repetitive-signal correction process shown in FIG. 10. The repetitive-signal correcting unit 26 performs the repetitive-signal correction process.

As shown in FIG. 11, the repetitive-signal correcting unit 26 first receives the repetitive signals from the repetition-section calculating unit 24 (step S701).

The repetitive-signal correcting unit 26 then applies a filter to the received repetitive signals (step S702). Specifically, the repetitive-signal correcting unit 26 randomly selects one filter coefficient from the filter coefficients stored in the filter-coefficient storage unit 27, and applies the selected filter coefficient to the received repetitive signals.

If f(s) is the filter coefficient, x(t) is the signal of repetition section, the corrected signal y(t) of the repetition section is given by Expression (5) given below.

$$y(t) = \sum_{s=0}^{t-1} f(s)x(t-s) \tag{5}$$

Figure 12:
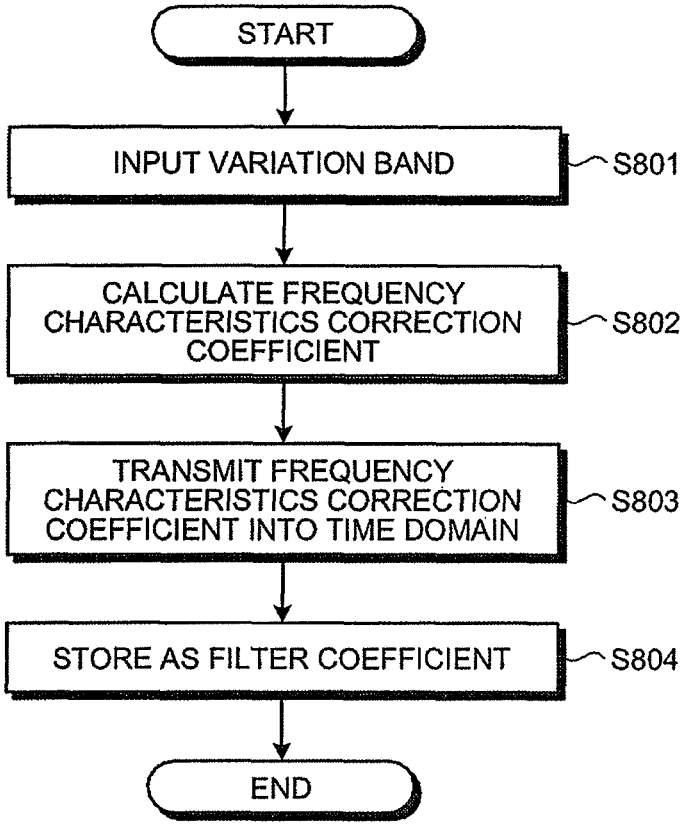
FIG. 12 is a flowchart of a process performed by a filter-coefficient generating unit.

A process performed by the filter-coefficient generating unit 28 is explained in the following. FIG. 12 is a flowchart of the process performed by the filter-coefficient generating unit 28. As shown in FIG. 12, the filter-coefficient generating unit 28 first inputs the variation band set beforehand (step S801). There are preset designated numerical values between from 0 to 2 in the input variation band.

The filter-coefficient generating unit 28 calculates a frequency characteristic correction coefficient for each preset frequency band unit based on the input variation band (step S802). If delta is the variation band, i is a number of preset frequency bands, the frequency characteristic correction coefficient coef[i] is calculated using Expression (6) given below.

$$\text{coef}[i]=\text{delta}\times rand[i] \tag{6}$$

In Expression (6), rand[i] is a numerical value, between −1 and +1, randomly generated on ith frequency band.

Next, the filter-coefficient generating unit 28 transforms the frequency characteristic correction coefficient coef[i] calculated using Expression (6) into a time-domain coefficient (step S803). For the transformation, the filter-coefficient generating unit 28 uses a widely known transformation technique such as inverse FFT The filter-coefficient generating unit 28 stores the time-domain coefficient retrieved by the transformation as the filter coefficient in the filter-coefficient storage unit 27 (step S804). The filter-coefficient generating unit 28 repeats the aforementioned process multiple number of times, and stores a plurality of filter coefficients in the filter-coefficient storage unit 27.

As mentioned hereinbefore, in the second embodiment, the repetitive-signal correcting unit 26 uses a variation signals having the amplitude which varies over time, and corrects the voice-transmission-signals of repetition section set by the repetition-section calculating unit 24. The controller 25 generates the concealment signal using the repetitive signals corrected by the repetitive-signal correcting unit 26. Therefore, completely identical voice-transmission-signals are no longer included in the concealment signal, and concealment signals can be generated in which the deterioration due to repetition is minimal.

In the second embodiment, it is explained that the filter-coefficient generating unit 28 generates the filter coefficient based on the frequency characteristic correction coefficient calculated from the preset variation band and the random numerical value(s). However, it is also acceptable to generate the filter coefficient based on the voice-transmission-signals stored in the normal-signal storage unit 11, the stored voice-transmission-signals being previously input voice-transmission-signals.

Figure 13:
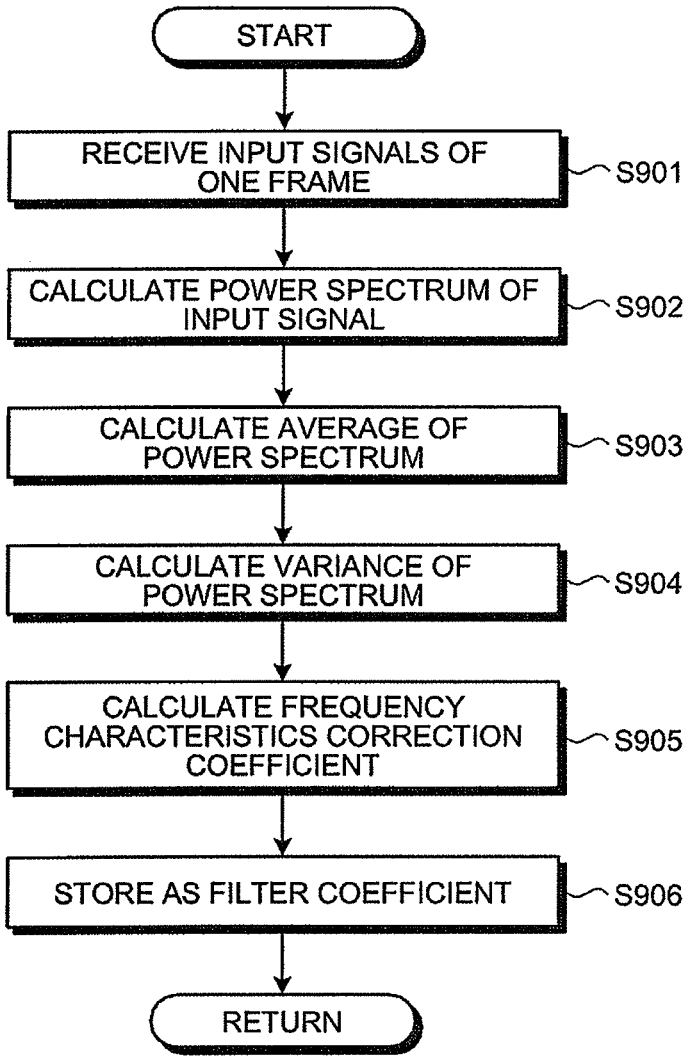
FIG. 13 is a flowchart of a process performed by the filter-coefficient generating unit when filter coefficients are generated based on previously input voice-transmission-signals.

FIG. 13 is a flowchart of the process performed by the filter-coefficient generating unit when the filter coefficients are generated based on the previously input voice-transmission-signals. As shown in FIG. 13, the filter-coefficient generating unit 28 inputs the voice-transmission-signals of one frame (step S901) stored in the normal-signal storage unit 11, and calculates the power spectrum of the signal (step S902). The filter-coefficient generating unit 28 calculates the power spectrum using a widely known technique such as FFT.

The filter-coefficient generating unit 28 calculates the average of the calculated power spectrum (step S903). If spec[i] is the power spectrum of ith frequency band, the average ave_spec[i] of the power spectrum is calculated using Expression (7) given below.

$$\text{ave_spec}[i]=(\text{prev_ave_spec}[i]\times(\text{num}-1)+\text{spec}[i])/\text{num} \tag{7}$$

In Expression (7), prev_ave_spec[i] is the average of previously calculated power spectrum, and num is a preset number of frames used while calculating the average of power spectrum.

Next, the filter-coefficient generating unit 28 calculates a power spectrum variance of the voice-transmission-signals (step S904). If std_spec[i] is a standard deviation of ith power spectrum, the variance vdelta[i] of the power spectrum is calculated using Expression (8) given below.

$$vdelta[i]=coef2[i]\times std_spec[i] \tag{8}$$

In Expression (8), coef[i] is a preset constant. The standard deviation std_spec[i] of ith power spectrum can be easily calculated using Expression (9) given below.

$$std_spec[i] = \frac{1}{num}\left(\sum_{t=1}^{spec-1} spec[i, t]^2\right) - ave_spec[i]^2 \tag{9}$$

In Expression (9), spec[i, t] is a power spectrum of ith version in the frame, ave_spec[i] is the average of ith power spectrum, and t is a serial number of the frame among num number of frames.

After calculating the variance vdelta[i], the filter-coefficient generating unit 28 calculates a frequency correction coefficient coef[i] using Expression (10) given below.

$$coef[i]=vdelta[i]\times rand[i] \tag{10}$$

In Expression (10), coef[i] is the frequency correction coefficient of ith frequency band, rand[i] is a numerical value between −1 to +1, randomly generated on ith frequency band.

The filter-coefficient generating unit 28 transforms the frequency characteristic correction coefficient coef[i] calculated using Expression (10) into a time-domain coefficient (step S905). For the conversion, the filter-coefficient generating unit 28 uses a widely known technique such as inverse FFT.

The filter-coefficient generating unit 28 stores the time-domain coefficient retrieved by conversion in the filter-coefficient storage unit 27 as the filter coefficient (step S906). The filter-coefficient generating unit 28 repeats the process multiple number of times and stores a plurality of filter coefficients in the filter-coefficient storage unit 27.

Thus, the filter-coefficient generating unit 28 generates filter coefficients based on the frequency characteristics of the previously input voice-transmission-signals. As a result, the signal of repetition section can be corrected into a signal that has a variance similar to the variance in the previously input voice-transmission-signals, thus enabling to generate a concealment signal with more natural sound quality conversion.

In the present embodiment, the concealment signal generator is explained. However, by realizing the configuration of the concealment signal generator with support of software, a computer-readable recording medium that stores therein a computer program causing the computer to execute the same functions can be retrieved. A computer including the computer-readable recording medium that stores therein a computer program causing a computer to execute the concealment signal generation program is explained.

Figure 14:
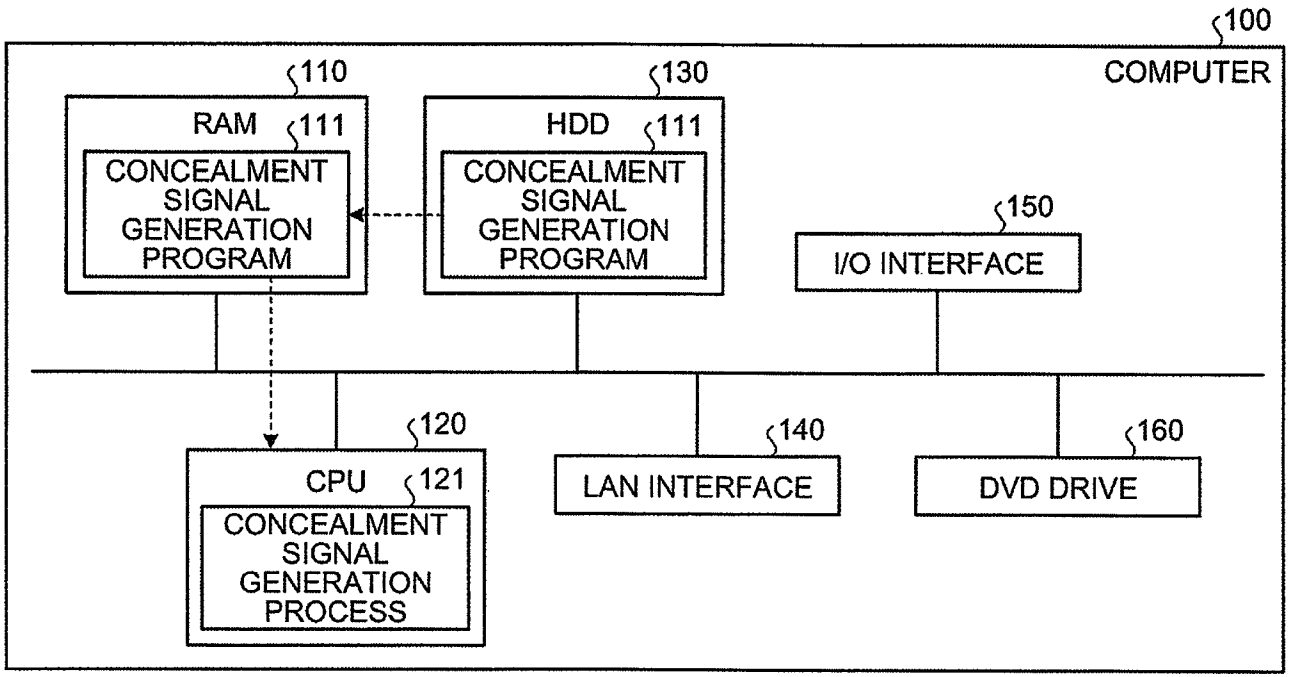
FIG. 14 is a functional block diagram of a computer that executes a computer program generating a concealment signal concealing missing voice-transmission-signals.
Figure 15:
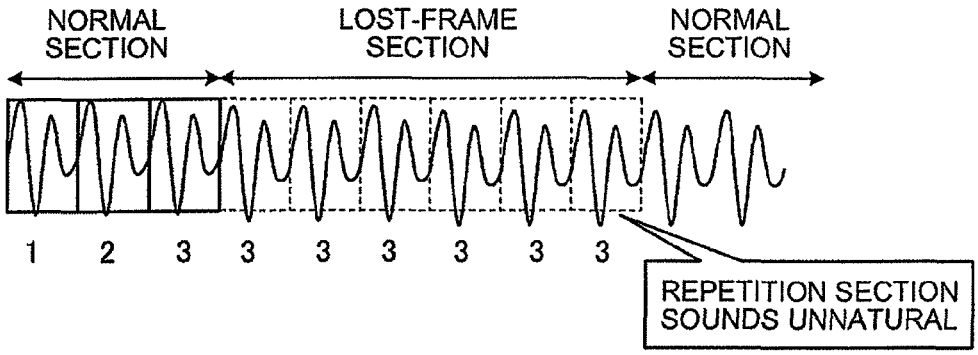
FIG. 15 is a schematic for explaining the problem posed by the conventional concealment signal generation method.

FIG. 14 is a functional block diagram of the computer including the computer-readable recording medium that stores therein a computer program causing a computer to execute the concealment signal generation program according to the present embodiment. As shown in FIG. 14, a computer 100 includes a random access memory (RAM) 110, a central processing unit (CPU) 120, a hard disk drive (HDD) 130, a local area network (LAN) interface 140, an input-output interface 150, and a digital versatile disk (DVD) drive 160.

The RAM 110 stores the computer program and the results during the execution of the computer program. The CPU 120 reads the computer program from the RAM 110 and executes the computer program.

The HDD 130 stores the computer program and data. LAN interface is an interface for connecting the computer 100 to other computer via LAN.

The input-output interface 150 connects input devices, such as mouse and keyboard, and display devices. The DVD drive 160 performs reading and writing of the DVD.

A concealment signal generation program 111 executed in the computer 100 is stored in the DVD, read from the DVD by the DVD drive 160, and is installed in the computer 100

Optionally, the concealment signal generation program 111 is stored in a database of other computer connected through the LAN interface 140 etcetera, read from these databases, and is installed in the computer 100.

The installed concealment signal generation program 111 gets stored in the HDD 130, read in the RAM 110, and is executed as a signal-loss concealment process 121.

All the automatic processes explained in the present embodiment can be, entirely or in part, carried out manually. Similarly, all the manual processes explained in the present embodiment can be, entirely or in part, carried out automatically by a known method.

The processes, the controlling processes, specific names, and data, including various parameters mentioned in the description and drawings can be modified as required unless otherwise specified.

The constituent elements of the device illustrated are merely conceptual and may not necessarily physically resemble the structures shown in the drawings. For instance, the device need not necessarily have the structure that is illustrated. The device as a whole or in parts can be broken down or integrated either functionally or physically in accordance with the load or how the device is to be used.

The processes performed by the device can be entirely or partially realized by the CPU or a computer program executed by the CPU or by a hardware using wired logic.

According to the present invention, an occurrence of unnatural sound due to continuation of a fixed sound can be prevented, and a concealment signal with minimal sound deterioration can be generated.

According to the present invention, completely identical voice-transmission-signals are no longer included in the concealment signal, and a concealment signal with further minimized deterioration due to repetition can be retrieved According to the present invention, a signal of similar section can be corrected into a signal that has a variance similar to the previously input voice-transmission-signals, thus enabling to generate a concealment signal with more natural transformation of sound quality.

According to the present invention, a concealment signal can be generated using voice-transmission-signals that resemble the voice-transmission-signals preceding the missing voice-transmission-signal, thus enabling to generate concealment signal with further minimized sound deterioration.

According to the present invention, a section out of the input voice-transmission-signals that has minimal sound quality variance can be set as the similar section. As a result, even if voice loss occurs in an environmental noise section, repetitive signals at different positions and with different lengths can be generated every time voice loss occurs, and a concealment signal with minimal sound quality deterioration can be generated without causing periodicity induced by the repetition.

According to the present invention, the signal of a section, for which there is a possibility of sound quality deterioration due to large amplitude variance when the section is used as a repetitive signal, can be eliminated, thus enabling to generate a concealment signal with further minimized sound quality deterioration.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A concealment signal generator that generates a concealment signal concealing a missing voice-transmission-signal, the concealment signal generator comprising:

a memory; and a processor coupled to the memory, wherein the processor executes a process comprising:

detecting, from a previously input voice-transmission-signal, a plurality of similar signals which are similar to a precedent voice-transmission-signal preceding the missing voice-transmission-signal;

selecting, from positions of the detected similar signals, repetition start positions at random;

setting each of different sections ranging from the selected each of the repetition start positions to the precedent voice-transmission-signal as each of different repetition sections; and generating the concealment signal by joining signals included in the set different repetition sections.

2. The concealment signal generator according to claim 1, wherein the process further comprises correcting voice-transmission-signals included in the set different repetition sections, by using a variation signal having an amplitude that varies over time, and the generating includes generating the concealment signal by using the corrected voice-transmission-signals.

3. The concealment signal generator according to claim 2, wherein the correcting includes correcting the voice-transmission-signals by using the variation signal, the variation signal being generated based on a frequency characteristic of the previously input voice-transmission-signal.

4. The concealment signal generator according claim 1, wherein the process further comprises determining a stationarity in a similarity variance between the previously input voice-transmission-signal and the precedent voice-transmission-signal, and the detecting includes detecting the similar signals from a voice-transmission-signal that is determined to have the stationarity by the determining.

5. The concealment signal generator according to claim 4, wherein the determining includes determining the stationarity based on a peak value variance of the similarity variance.

6. The concealment signal generator according to claim 4, wherein the determining includes determining the stationarity based on an amplitude variance of the similarity variance.

7. A concealment signal generation method for generating a concealment signal concealing a missing voice-transmission-signal, the concealment signal generation method comprising:

detecting, from a previously input voice-transmission-signal, a plurality of similar signals which are similar to a precedent voice-transmission-signal preceding the missing voice-transmission-signal;

selecting, from positions of the detected similar signals, repetition start positions at random;

setting each of different sections ranging from the selected each of the repetition start positions to the precedent voice-transmission-signal as each of different repetition sections; and generating the concealment signal by joining signals included in the set different repetition sections.

8. The concealment signal generation method according claim 7, further comprising determining a stationarity in a similarity variance between the previously input voice-transmission-signal and the precedent voice-transmission-signal, wherein the detecting includes detecting the similar signals from a voice-transmission-signal that is determined to have the stationarity by the determining.

9. A computer-readable non-transitory recording medium that stores therein a computer program for generating a concealment signal concealing a missing voice-transmission-signal, the computer program causing the computer to execute:

detecting, from a previously input voice-transmission-signal, a plurality of similar signals which are similar to a precedent voice-transmission-signal preceding the missing voice-transmission-signal;

selecting, from positions of the detected similar signals, repetition start positions at random;

setting each of different sections ranging from the selected each of the repetition start positions to the precedent voice-transmission-signal as each of different repetition sections; and generating the concealment signal by joining signals included in the set different repetition sections.

10. The computer-readable non-transitory recording medium according to claim 9, wherein the computer program further causing the computer to execute:

determining a stationarity in a similarity variance between the previously input voice-transmission-signal and the precedent voice-transmission-signal, wherein the detecting includes detecting the similar signals from a voice-transmission-signal that is determined to have the stationarity by the determining.

* * * * *